US006457263B1

(12) United States Patent
Rudy

(10) Patent No.: US 6,457,263 B1
(45) Date of Patent: Oct. 1, 2002

(54) ARTICLE OF FOOTWEAR HAVING MULTIPLE FLUID CONTAINING MEMBERS

(76) Inventor: Marion Franklin Rudy, 19001 Vintage St., Northridge, CA (US) 91324

( * ) Notice: Subject to any disclaimer, the term of this patent is extended or adjusted under 35 U.S.C. 154(b) by 0 days.

(21) Appl. No.: 09/688,670

(22) Filed: Oct. 16, 2000

Related U.S. Application Data

(63) Continuation of application No. 09/505,180, filed on Feb. 16, 2000, now Pat. No. 6,158,149, which is a division of application No. 09/024,353, filed on Feb. 17, 1998, which is a continuation of application No. 08/345,940, filed on Nov. 28, 1994, now abandoned.

(51) Int. Cl.[7] ..... A43B 13/20; A43B 21/26; A43B 7/14

(52) U.S. Cl. ..... 36/29; 36/35 B; 36/153

(58) Field of Search ..... 36/28, 29, 30 R, 36/31, 35 B, 71, 93, 153

(56) References Cited

U.S. PATENT DOCUMENTS

| | | | |
|---|---|---|---|
| 259,092 | A | 6/1882 | Butterfield |
| 302,190 | A | 7/1884 | Butterfield |
| 547,645 | A | 10/1895 | Lacroix |
| 2,109,180 | A | 2/1938 | Morin |
| 2,677,906 | A | 5/1954 | Reed |
| 2,701,770 | A | 2/1955 | Melzer |
| 2,703,770 | A | 3/1955 | Melzer |
| 3,005,272 | A | 10/1961 | Shelare et al. |
| 3,120,712 | A | 2/1964 | Menken |
| 3,407,406 | A | 10/1968 | Werner et al. |
| 3,685,176 | A | 8/1972 | Rudy |

(List continued on next page.)

FOREIGN PATENT DOCUMENTS

| | | |
|---|---|---|
| DE | 2428357 | 6/1974 |
| EP | 0 095 357 A1 | 11/1983 |
| EP | 0 510 943 A2 | 4/1992 |
| GB | 14955 | 6/1894 |
| GB | 7441 | 9/1906 |
| GB | 495151 | 2/1920 |
| GB | 385060 | 12/1932 |
| JP | G-181802 | 7/1994 |
| JP | 6-181802 | 7/1994 |
| WO | 93/12685 | 7/1993 |
| WO | 93/14659 | 8/1993 |
| WO | 95/20332 | 8/1995 |

OTHER PUBLICATIONS

Air Force 180 Commercial Document; 1 page.

*Primary Examiner*—Anthony D. Stashick
(74) *Attorney, Agent, or Firm*—Fay, Sharpe, Fagan, Minnich & McKee, LLP

(57) ABSTRACT

An article of footwear includes one or more first fluid containing cushion devices in direct or elastomeric load transmitting contact with a foot to provide superior comfort. One or more second, preferably thicker, fluid containing cushion devices are positioned in a load transmitting portion of the sole, between the foot and ground engaging surface of the footwear. The first cushion devices) at least partially overlap a portion of the second cushioning devices) and the two cushion devices are at least partially separated in any overlapping areas by a load distributing element.

13 Claims, 8 Drawing Sheets

U.S. PATENT DOCUMENTS 3,760,056 A 9/1973 Rudy
4,100,686 A 7/1978 Searlato et al.
4,183,156 A 1/1980 Rudy
4,187,620 A 2/1980 Seiner
4,217,705 A 8/1980 Donzis
4,219,945 A 9/1980 Rudy
4,223,457 A 9/1980 Borgeas
4,263,728 A 4/1981 Frecentese
4,271,606 A 6/1981 Rudy
4,287,250 A 9/1981 Rudy
4,297,797 A 11/1981 Meyers
4,305,212 A 12/1981 Coomer
4,340,626 A 7/1982 Rudy
4,358,902 A 11/1982 Cole et al.
4,370,754 A 2/1983 Donzis
4,417,407 A 11/1983 Fukuoka
4,445,283 A 5/1984 Meyers
4,446,634 A 5/1984 Johnson et al.
4,471,538 A 9/1984 Pomeranz et al.
4,472,890 A 9/1984 Gilbert
4,485,430 A 11/1984 Peterson
4,486,901 A 12/1984 Donzis
4,486,964 A 12/1984 Rudy
4,490,928 A 1/1985 Kawashima
4,506,460 A 3/1985 Rudy
4,567,677 A 2/1986 Zona
4,670,995 A 6/1987 Huang
4,722,131 A 2/1988 Huang
4,724,560 A 2/1988 Christie
4,724,627 A 2/1988 Sisco
4,744,157 A 5/1988 Dubner
4,768,295 A 9/1988 Ito
4,779,359 A 10/1988 Famolare, Jr.
4,817,304 A 4/1989 Parker et al.
4,829,682 A 5/1989 Gasbarro
4,864,737 A 9/1989 Marrello
4,864,738 A 9/1989 Horovitz
4,906,502 A 3/1990 Rudy
4,910,060 A 3/1990 Nakanishi
4,914,836 A 4/1990 Horovitz
4,934,070 A 6/1990 Mauger
4,934,072 A 6/1990 Fredericksen
4,936,029 A 6/1990 Rudy
4,936,030 A 6/1990 Rennex
5,042,176 A 8/1991 Rudy
5,067,255 A 11/1991 Hutchseon
5,083,361 A 1/1992 Rudy
5,097,607 A 3/1992 Fredericksen
5,101,580 A 4/1992 Lyden
5,155,927 A 10/1992 Bates et al.
5,189,816 A 3/1993 Shibata
5,191,727 A 3/1993 Barry
5,220,737 A 6/1993 Edington
5,224,277 A 7/1993 Sang Do
5,226,245 A 7/1993 Lamont
5,228,217 A 7/1993 Dabuzhsky et al.
5,229,217 A 7/1993 Dabuszky et al.
5,230,249 A * 7/1993 Sasaki et al. ..... 36/132
5,235,715 A 8/1993 Donzis
5,245,766 A 9/1993 Warren
5,253,435 A 10/1993 Auger et al.
5,283,963 A 2/1994 Lerner et al.
5,287,638 A 2/1994 Preston
5,311,623 A 5/1994 Hendi
5,315,769 A 5/1994 Barry et al.
5,335,382 A 8/1994 Huang
5,353,459 A 10/1994 Potter et al.
5,375,346 A * 12/1994 Cole et al. ..... 36/29
5,545,463 A 8/1996 Schmidt et al.
5,771,606 A 6/1998 Litchfield et al.
5,846,063 A 12/1998 Lackic

* cited by examiner

ARTICLE OF FOOTWEAR HAVING MULTIPLE FLUID CONTAINING MEMBERS

This application is a continuation of patent application Ser. No. 09/505,180 filed Feb. 16, 2000 now U.S. Pat. No. 6,158,149 which is a division of patent application Ser. No. 09/024,353 filed Feb. 17, 1998, which is a continuation of patent application Ser. No. 08/345,940 filed Nov. 28, 1994 now abandoned.

FIELD OF THE INVENTION

This invention relates to articles of footwear having improved cushioning, comfort and stability. Particularly, this invention relates to articles of footwear that include cushioning devices which provide superior comfort to a wearer and provide superior performance under high loading conditions.

BACKGROUND OF THE INVENTION

Articles of footwear have long been studied and redesigned to achieve enhanced comfort and performance. In this regard, and particularly in athletic shoes, primary concerns include the ability to provide the foot with a comfortable environment and to mitigate the shock or impact experienced when the shoe and, accordingly the foot and lower leg, impact the ground or floor. These forces are particularly significant during running and jumping. For example, a jogger landing on four or five square inches of the heel is estimated to absorb an impact force of about three to four times the weight of the jogger. Accordingly, a jogger of 180 pounds may create an approximate force of 720 pounds of shock on the heel landing area. Since each heel could impact the ground about 800 times per mile, it is easy to see the necessity of a shock absorbing mechanism in footwear.

In addition to a shoe absorbing intense and repeated impact, the criticality of comfort is readily understood by everyone who wears shoes. In fact, comfort in athletic shoes is known to effect the wearer's psychological state, and therefore, his or her performance, muscular efficiency, energy consumption, and the athlete's ability to train and compete.

A variety of elastomeric materials, including natural rubber, polymerized and copolymerized elastomers, and synthetic rubbers have been used in shoe construction to absorb these forces. However, these elastomeric materials suffer degradation from repeated use and have relatively poor energy transfer efficiency characteristics. Accordingly, the industry has searched for alternative means of foot cushioning.

In this search, pneumatic cushioning devices have long been studied. For example, U.S. Pat. No. 259,092 (1882) demonstrates a very early pneumatic sole. Notwithstanding the long search, pneumatic cushioning devices failed for nearly a century and for a variety of reasons to achieve commercial success. In fact, until the inventions described in U.S. Pat. Nos. 4,183,156 and 4,219,945 were made, the art lacked the technological know-how to make pneumatic cushioning in shoes commercially successful. The inventions described in these patents revolutionized shoe design and the athletic footwear market place, having been incorporated into at least 200 million shoes sold worldwide.

Following this initial success of pneumatic cushioning, several attempts to improve these systems have been made. U.S. Pat. No. 4,506,460, for example, discloses a moderator device which functions in combination with either elastomeric or pneumatic cushioning elements. The moderator is used to absorb, redistribute, store and return energy. U.S. Pat. No. 5,083,361 describes a shoe including a stacked air chamber arrangement. In this design, the air chambers are constructed with an outer barrier layer of elastomeric material with drop-linked fabric to average stress of the chambers and maintain stability. It is also suggested to inflate the top chamber to a lower pressure in order to provide initial contact softness.

Taiwanese Application No. 75100322 discloses an outboard double deck air cushion where the peripheral air chambers in the top unit and the peripheral air chambers in the bottom unit are in fluid communication. The central air chambers of the top air cushion and those of the bottom air cushion are also in fluid communication. This design is intended to provide an air insert which continues to support the wearer after being punctured. For that purpose, the design includes a piercing proof sheet material such as a light metal between the first and second air cushions to prevent puncture of the upper cushion. However, this design, by allowing fluid communication between the top and bottom air cushions, may be unstable as a result of rapid, almost instantaneous, dispersion of air pressure under a load applied to localized areas. More particularly, this design appears to act more like a thick single cushion insert than two separate units. In fact, it is believed that this design leads to "bottoming out" of heavily loaded chambers and the simultaneous ballooning of unloaded chambers, causing instability when an uneven force is applied to the plantar surface of the foot of the outsole of the shoe. This instability termed herein a "tennis ball" effect appears to be particularly true when the cushions total more than 0.800 inches in thickness. Accordingly, this design presents an injury risk and fails to provide the advantage of superior comfort and superior performance in an article of footwear.

As is apparent from the above description of the art, a need exists for a cushioning system which provides both the comfort and performance benefits of fluid cushioning. This invention provides a means to achieve several very important goals; superior comfort in a shoe in combination with superior technical performance and lightness of weight.

SUMMARY OF THE INVENTION

In accordance with the purpose of the invention as embodied and broadly described herein, the article of footwear of this invention comprises a shoe upper shaped to envelop and cushion the foot. The upper is attached to a sole having a ground engaging portion. A first sealed elastomeric member containing a fluid is positioned in the article of footwear between at least a portion of the foot and the ground engaging portion of the sole. A second sealed elastomeric member containing a fluid is positioned between the foot and the ground engaging portion of the sole, with at least a portion of the first member overlapping the second member. A load distributing element is positioned between the first and second members, intermediate at least a portion of the overlapping region of the members.

The first member of this shoe is preferably located within the shoe's foot constraining envelope, and is termed "inboard" for purposes of this disclosure. This location provides exceptional point-of-sale appeal, because the fluid containing cushion insert is in direct elastomeric proximity with the plantar surface of the foot, providing the wearer with a clear "riding-on-air" sensation (in the case of air filled inserts). Preferably, the sewed elastomeric member is located in the sole of the shoe, exterior and below the shoe upper envelope easing the foot, and is termed "outboard".

This cushion is preferably designed to absorb and beneficially redistribute, store and return significant impact forces.

Accordingly, an article of footwear is described with a fluid containing elastomeric cushioning device adjacent the foot and a fluid containing elastomeric cushioning device more proximate the ground engaging surface of the shoe. In certain embodiments, the fluid containing cushioning device nearer the ground engaging surface of the shoe may be constructed with one side functioning as the ground engaging surface of the shoe.

A load distributing element is located between the two cushioning devices to prevent painful and destabilizing localized forces and to facilitate load dispersion across the cushioning devices, increasing their effectiveness. In this preferred design, the two cushioning devices respectively provide comfort and performance and, in fact, overall superior cushioning may occur. Therefore, this invention advantageously provides a new and improved article of footwear providing both superior comfort and performance.

BRIEF DESCRIPTION OF THE DRAWINGS

The invention consists of the novel parts, construction, arrangements, combinations and improvements shown and described. The accompanying drawings, which are incorporated and constitute a part of the specification illustrate the invention and, together with the description, serve to explain the principles of the invention.

Of the drawings.

DETAILED DESCRIPTION OF THE INVENTION

Reference will now be made in detail to the present preferred embodiment of the invention, an example of which is illustrated in the accompanying drawings. While the invention will be described in connection with the preferred embodiment, it will be understood that it is not intended to limit the invention to that embodiment. On the contrary, it is intended to cover all alternatives, modifications and equivalents as may be included within the spirit and scope of the invention defined by the appended claims.

Figure 1:
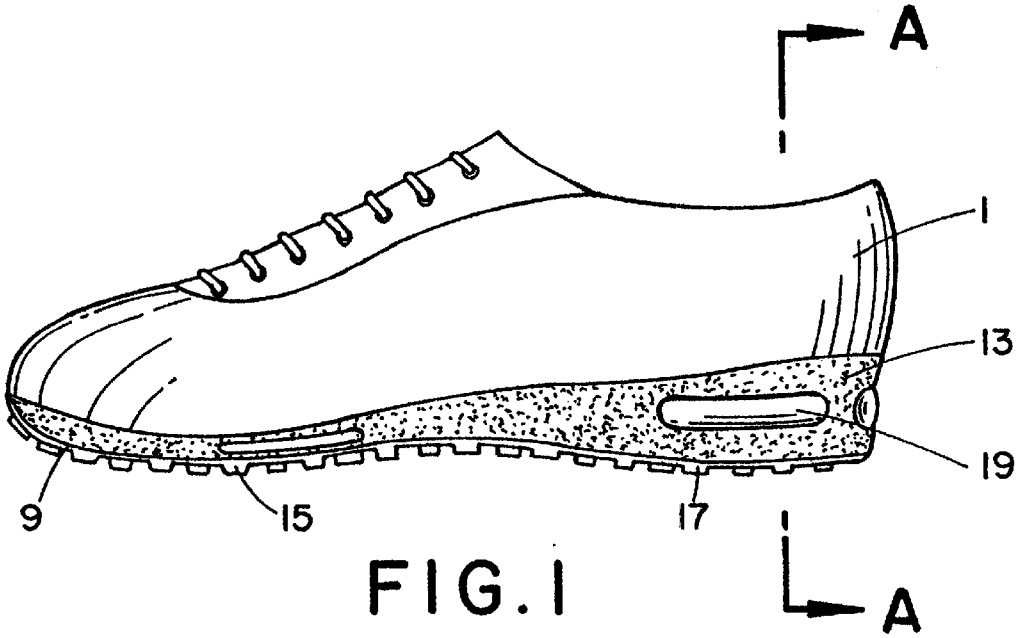
FIG. 1 is a side elevation view of a shoe incorporating a preferred embodiment of the invention.
Figure 2:
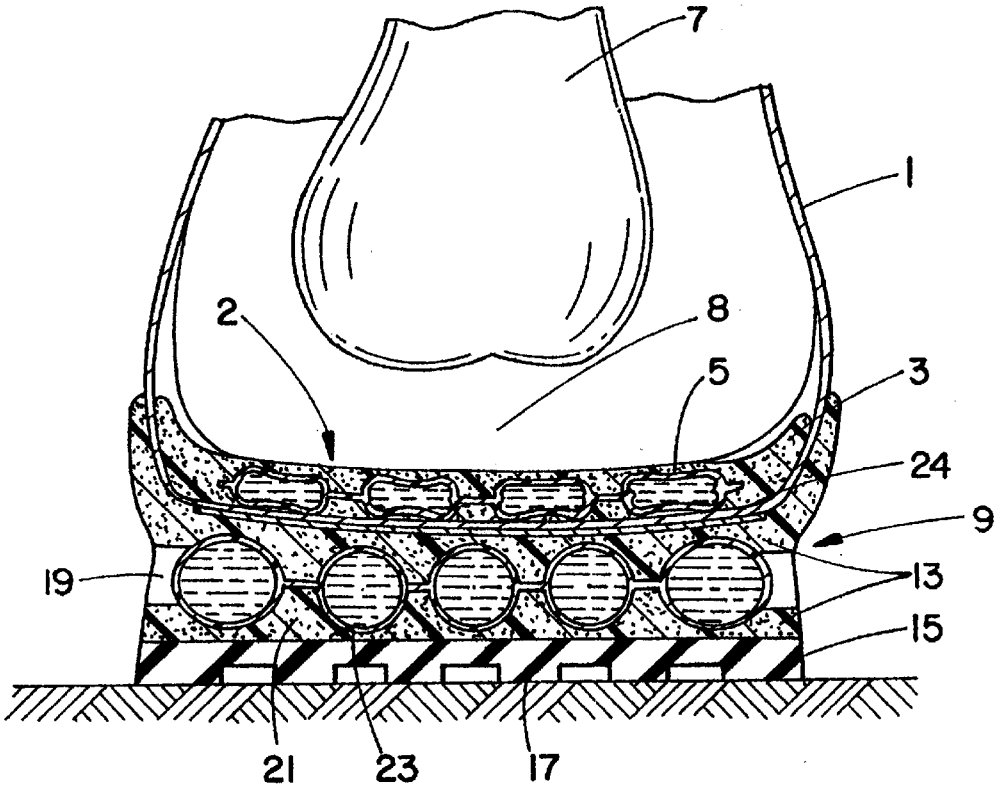
FIG. 2 is a diagrammatic view, partly in section and partly in elevation taken on line A—A of FIG. 1, under a standing load condition.

Referring now to FIGS. 1 and 2, it may be seen that an article of footwear having an inboard cushioning device primarily for comfort and an outboard cushioning device primarily for absorbing high load is provided. The footwear includes an upper 1 generally trade of leather, nylon or other material or other combination of materials known to those of ordinary skill in the art. Positioned within the upper 1 is a sockliner 2 Comprised of an elastomeric material such as foam 3, encapsulating at least the upper surface of an inboard fluid containing cushioning device 5. Accordingly, the calcaneus bone 7 and fat pad 8 are in elastomeric contact with the inboard cushioning device 5.

The upper 1 is formed by any means acceptable to those of skill in the art such as, but not limited to, boardlasting or stitchlasting. The upper shown herein is appropriate for athletic shoes, however, sandal uppers and boot uppers are equally suited for combinations with the sole construction of this invention. The sole 9 is secured to the upper by glue and/or stitching, of other techniques well known to those skilled in the art. The preferred sole 9 comprises a midsole portion 13 and outsole portion 15 contacting the ground. The outsole portion 15 is generally textured with tread or studs 17 to facilitate good frictional engagement with the ground or a floor surface. Midsole 13 is comprised of a foam 21 encapsulated outboard fluid containing cushioning device 23, visible through view holes 19. As is apparent, a load distributing element 24 is positioned intermediate the two cushioning devices 5 and 23.

A variety of cushioning devices and designs can be incorporated into this invention. In addition to the cushioning devices 5 and 23, other preferred cushioning devices, their manner of production, assembly, and incorporation into footwear are described in U.S. Pat. Nos. 3,005,272; 3,685,176; 3,760,056; 4,183,156; 4,217,705; 4,219,945; 4,271,606; 4,287,250; 4,297,797; 4,340,626; 4,370,754; 4,471,538; 4,486,901; 4,506,460; 4,724,627; 4,779,359; 4,817,304; 4,829,682; 4,864,737; 4,864,738;4,906,502; 4,936,029; 5,042,176; 5,083,361; 5,097,607; 5,155,927; 5,228,217; 5,235,715; 5,245,766; 5,283,963; and 5,315,769 each of which is herein incorporated by reference.

As will be understood by one of ordinary skill in the art, the cushioning inserts may be positioned as desired under the foot. Particularly preferred areas are under the heel, the longitudinal arch and under the metatarsals (i.e., the ball-of-the-foot). Included within the meaning of an inboard or outboard, first or second, cushioning device as used throughout this description are cushions comprised of multiple, separate and/or distinct cushioning peds. For example, the outboard cushioning device proximate the ground engaging surface of the shoe may be comprised of a heel pad and a separate toe pad. Accordingly, the heel and toe peds, although not connected, together are referred to herein as one outboard cushioning device.

Preferably, the elastomeric material of the cushioning devices is selected from the following: polyurethane, polyester elastomer; fluorcelastomer; chlorinated polyethylene, polyvinylchloride; chlorosulfinated polyethylene; polyethylene/ethylene vinyl acetate copolymer; neoprene; butadiene acrylonitrile rubber; butadiene styrene rubber; ethylene propylene polymer; natural rubber; high strength silicone rubber; low density polyethylene; adduct rubber; sulfide rubber; methyl rubber; and thermoplastic rubber. One material that is particularly preferred is polyurethane film.

When a compressible fluid is desired, the elastomeric members are preferably filled with a compressible "super-gas" comprising a non-polar large molecule gas or gases and air. These fall within the self-inflating, via diffusion pumping technology, of the above described prior patents. Gases which have been found suitable are as follows: hexafluoroethane; sulfur hexafluoride; perflouro propane; perfluorobutane; perfluoropentane; perfluorohexane; perfluoroheptane; octafluorocyclobutane; perflourocylobutane; hexafluoropropylene; tetrafluoromethane; monochloropentafluoroethane; 1,2-dichlorotetra-fluoroethane; 1,1,2-trichloro-1,2,2-trifluoroethane; chlorotrifluoroethylene; bromotrifluoromethane; and monochlorotrifluoromethane. The two most desirable gases for use in the members are hexafluoroethane and sulfur hexafluoride. Of course, contemplated within the scope of this invention are cushioning devices filled with other compressible fluids in combination with foams and mechanically inflated gas (including air) cushioning devices.

Alternatively, the elastomeric member can be filled with a incompressible fluid which is generally a liquid or gel. The preferred characteristics of the fluid are that it is non-toxic, preferably odor free, it does not freeze at temperatures to which the article of footwear is normally exposed, and it possesses an acceptable viscosity, for example, 1,000 to 1,250 centistokes. Incompressible fluids such as water; semi-gel liquids; oil; grease; soft or liquid wax; glycerine; soft soaps; silicone; rheopexic fluids; thixotropic fluids; and corn syrups exemplify but are not limiting examples of acceptable fluids. The fluid can also be treated with a bactericide or anti-fungal agent for their obvious benefits.

In addition, cushioning members utilizing incompressible fluids have also been designed to include the combination of a particulate material and a liquid to tailor the viscosity and cushioning characteristics. Phenolic resin particles, silica and ceramic spheres are examples of particulate material which may be utilized. Of course, at least two cushioning devices of the invention can each be filled with different materials, i.e. air in the inboard cushion and viscous silicone oil in the outboard cushion. In addition, the cushioning devices may be filled with a combination of incompressible fluid and compressible fluid.

The article of footwear in FIG. 2 is now referred to for illustration of certain properties of the invention. Particularly, a fluid containing inboard cushioning device is positioned to provide substantially uninterrupted elastic cushioning to the foot within the foot constraining envelope of the shoe. This provides the article of footwear user with a "riding-on-air" feel (when air/gas filled) and the associated high degree of comfort. A generally thicker (defined along the axis between the foot and ground engaging surface of the shoe) and generally higher pressurized fluid containing outboard cushioning device (if a compressible fluid cushioning device is utilized) is positioned in the midsole. This thicker, higher pressure outboard cushioning device primarily functions to absorb and distribute high load conditions encountered during running, jumping, stopping and blocking.

Figure 3:
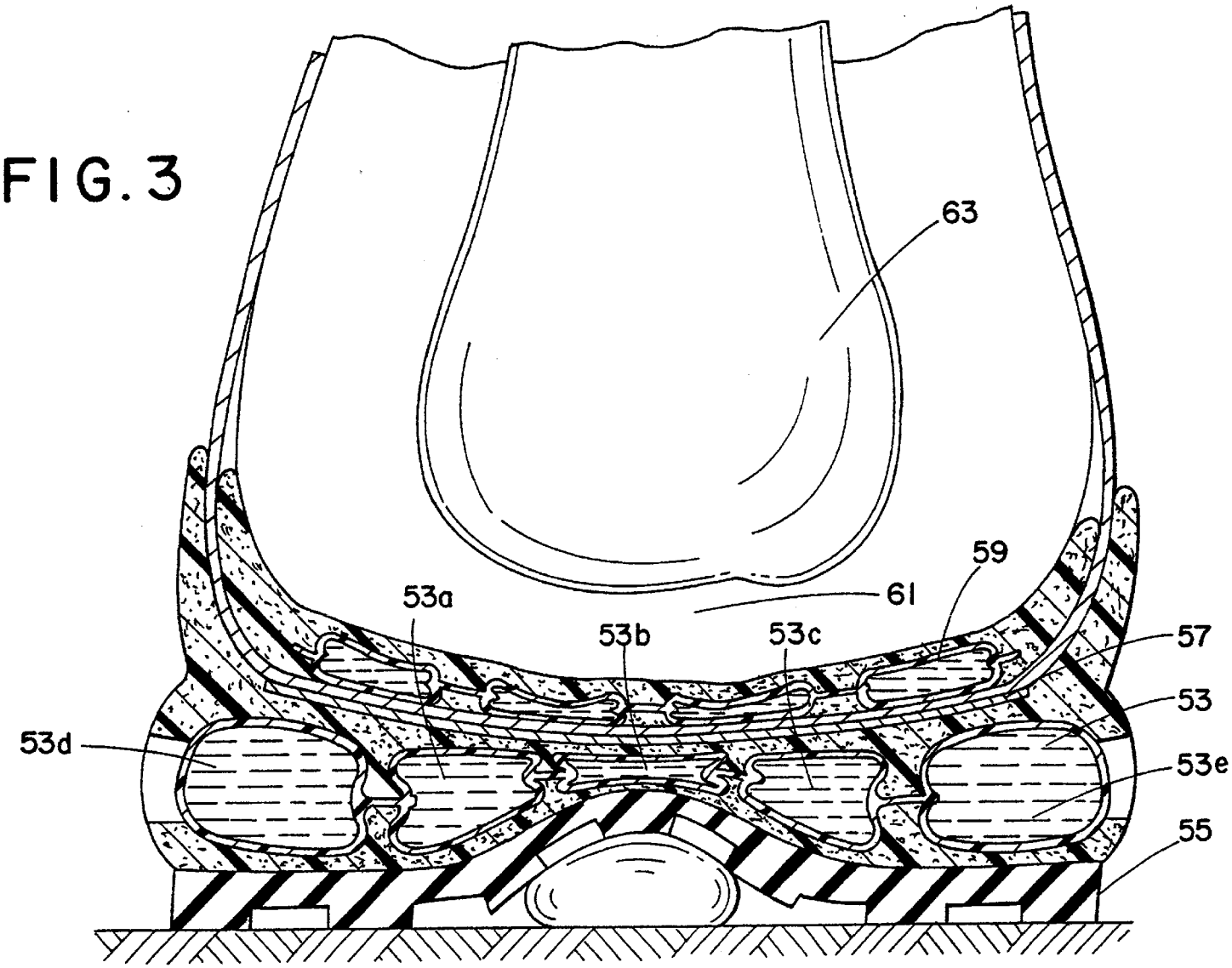
FIG. 3 is a diagrammatic view similar to FIG. 2, partly in section and partly in elevation, of a preferred embodiment shoe structure incorporating cushioning devices containing compressible fluids and the load distributing element of the current invention under a moderate load.
Figure 4:
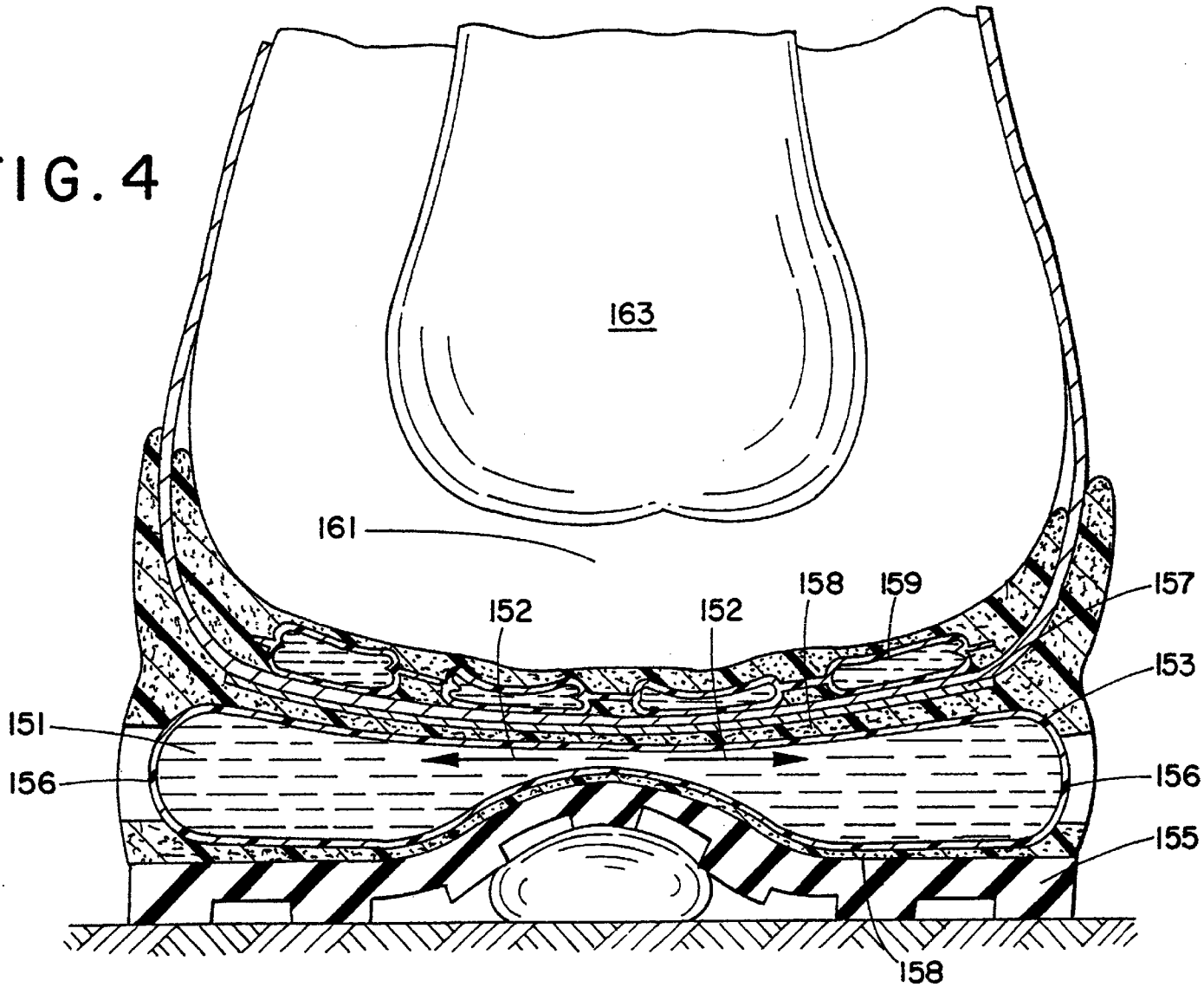
FIG. 4 is a diagrammatic view similar to FIG. 2, partly in section and partly in elevation, of a preferred embodiment shoe structure incorporating a cushioning device containing an incompressible fluid and the load distributing element of the current invention under a moderate load.
Figure 5:
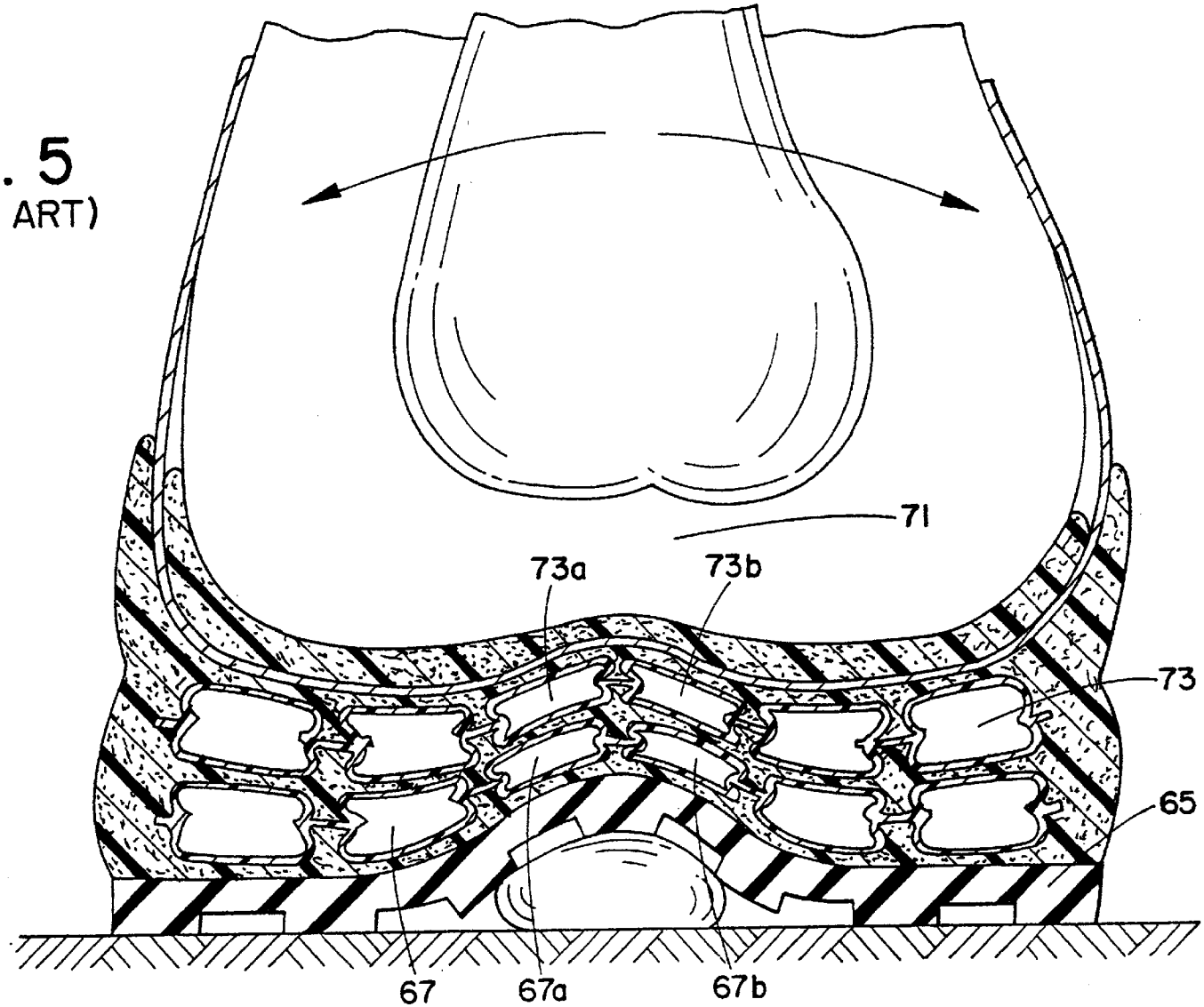
FIG. 5 (PRIOR ART)
FIG. 5 is a diagrammatic view similar to FIGS. 3 and 4, partly in section and partly in elevation, of a prior art shoe structure incorporating two outboard cushion devices is fluid communication under a moderate load.

The following examples illustrated by FIGS. 3, 4, and 5 comparatively demonstrate the useful and beneficial results achieved by this invention. FIG. 3 illustrates the footwear of the present invention under a moderate load. Moreover, FIG. 3 illustrates the load distribution mechanism of the current invention when uneven loading is applied. As illustrated, the foam encapsulated outboard performance oriented cushioning device 53 is compressed to absorb impact of the shoe with the ground having an uneven surface (a rock). Compression of individual chambers 53*a*, 53*b* and 53*c* is more significant as a result of the added stresses to the outsole 55 at the point of engagement with the rock. However, the load distributing element 57 prevents significant localized vertical deflection, effecting a horizontal force distribution of the high localized load, transferring the forces of the individual chambers (53*a*, 53*b* and 53*c*) across a large surface area of the inboard downward deflecting comfort insert 59. Accordingly, the load is more equally distributed across the fat pad of the heel 61, reducing the possibility of instability or a stone bruise to the heel of the foot by the outboard cushioning chambers 53*a*, 53*b*, and 53*c* pushed upward by the rock. In addition, the shoe design more evenly distributes the force as the gas moves from chambers 53*a*, 53*b* and 53*c* into chambers 53*d* and 53*e*, providing greater comfort and less jarring to the calcaneus 63 and the remainder of the lower leg and body.

Under a light load, the inboard insert 59 supported on an appropriate load distributing element 57 provides a perceived, dynamic, instantaneous, plantar foot shape conforming "riding-on-air", comfort and support for the foot. Under higher loads, the inboard cushioning device 59 deflects and cushions in a downward motion against the load distributing element 57 through its full range of cushioning support from the maximum thickness at an unloaded condition to a bottoming out condition. Coincidentally, additional deformation of outboard device 53 occurs and higher shock loads are absorbed. The load distributing element provides a load supportive, flexible, dynamic plane, which is either flat or anatomically contoured. This plane separates the normally downward load deflection and cushioned forces of the foot all or in part, from the upward vectored shock forces absorbed and cushioned substantially by the outboard cushioning device, emanating from the impact of the shoe outsole with the floor or ground.

Referring now to FIG. 4, the footwear of the present invention under a moderate load is demonstrated wherein the outboard cushioning device 153 is a incompressible fluid design. In this design, the outboard cushioning device 153 is encapsulated within midsole 155. Cushioning device 153 is flexibly secured at its top and bottom surfaces with an elastomeric encapsulating foam 158. Under a moderate load with a uneven force distribution caused by the rock, incompressible fluid 151 is forced from the central region of cushioning device 153 flowing in the direction of arrows 152 toward the periphery 156 of the cushioning device. Fluid flow causes an increased pressure at the periphery 156 of the cushioning device and a bulging of the elastomeric cushioning device in this side wall area. Accordingly, shock forces are absorbed by the elastomeric action of the peripheral chamber walls 156 and the forced fluid flow. As in FIG. 3, load distributing element 157 disperses uneven forces caused by the rock more uniformly across the inboard cushioning member 159. Therefore, the fat pad 161 and calcaneus 163 are not subject to instability or a stone bruise. Although FIG. 4 demonstrates a outboard incompressible fluid cushioning device and an inboard compressible fluid cushioning device, these elements could be reversed or incompressible cushioning units could be utilized both inboard and outboard.

While the outboard incompressible fluid cushioning device is shown as a single unit, including an adjacent cavity for expansion, a variety of designs can clearly be utilized in the present invention. For example, multi-chambered units having fluid connections between at least some of the units can be used. In addition, flow restrictors may be utilized between the chambers to tailor the fluid flow to meet required cushioning demands. Other designs include a heel chamber connected via channels to a chamber under the metatarsals causing fluid flow toward the forward chamber on heel strike and rearward during toe off. Particularly preferred incompressible fluid containing designs include a small amount of compressible fluid in the chamber or a connected chamber containing predominantly incompressible fluid which allows compression within the chamber to occur in addition to expansion of the elastomeric cushioning walls when a load is applied.

The same moderate load conditions are demonstrated in FIG. 5, however, both upper and lower cushioning devices are outboard and are in fluid communication (not shown) with one another. This illustration demonstrates the importance of having fluid independence of the two cushioning insects to provide stability and achieve a comfortable and high performance cushioning effect. Under conditions repeating those of FIGS. 3 and 4, the shoe of FIG. 5, with fluid communication between the cushioning units, leads to discomfort, instability and possible foot injury. More particularly, when a localized high load area (a rock in this example) is encountered by the shoe outsole 65, forces are transmitted upward through the cushioning member 67, leading to upward deflection of the outboard chambers 67*a* and 67*b*. Because cushioning member 67 is in fluid communication with cushioning member 73, under applied load, the fluid pressure in all chambers of cushioning members 67 and 73 nearly instantaneously equalize. Chambers 67*a* and 67*b*, bottom-out and press upwardly against cushioning member 73. Since there is no load distributing member the cushioning members also thrust upwardly, pressing against the bottom surface of the foot creating a very uncomfortable and painful bulge within the shoe. Chambers 67*a* and 67*b*, 73*a* and 73*b*, nearly totally bottom out allowing the pressure of the rock to transmit almost directly into fat pad 71 of the heel of the foot. The fluid communication between the upper and lower cushioning members results in instability characteristic of a single very thick air cushion device and provides an excellent example of a "tennis ball" effect. Furthermore, the outboard cushioning design of both members 67 and 73 fail to provide the distinct comfort associated with the "riding-on-air" feel, characteristic of the inboard positioning of one of the cushioning members.

Accordingly, FIGS. 3 and 4 evidence how a preferred embodiment functions in a unique, novel, and highly beneficial way over prior art designs. It achieves the best of both worlds, i.e., the "riding-on-air" cushioned comfort, softness, formability and pliancy which is dynamically integrated with the technical and sophisticated world of high impact energy absorption, distribution, storage and efficient dynamic energy return as well as rear and forefoot stability, motion control, banked track effect when stopping and blocking, injury protection orthotic support, pronation control, etc.

Figure 6:
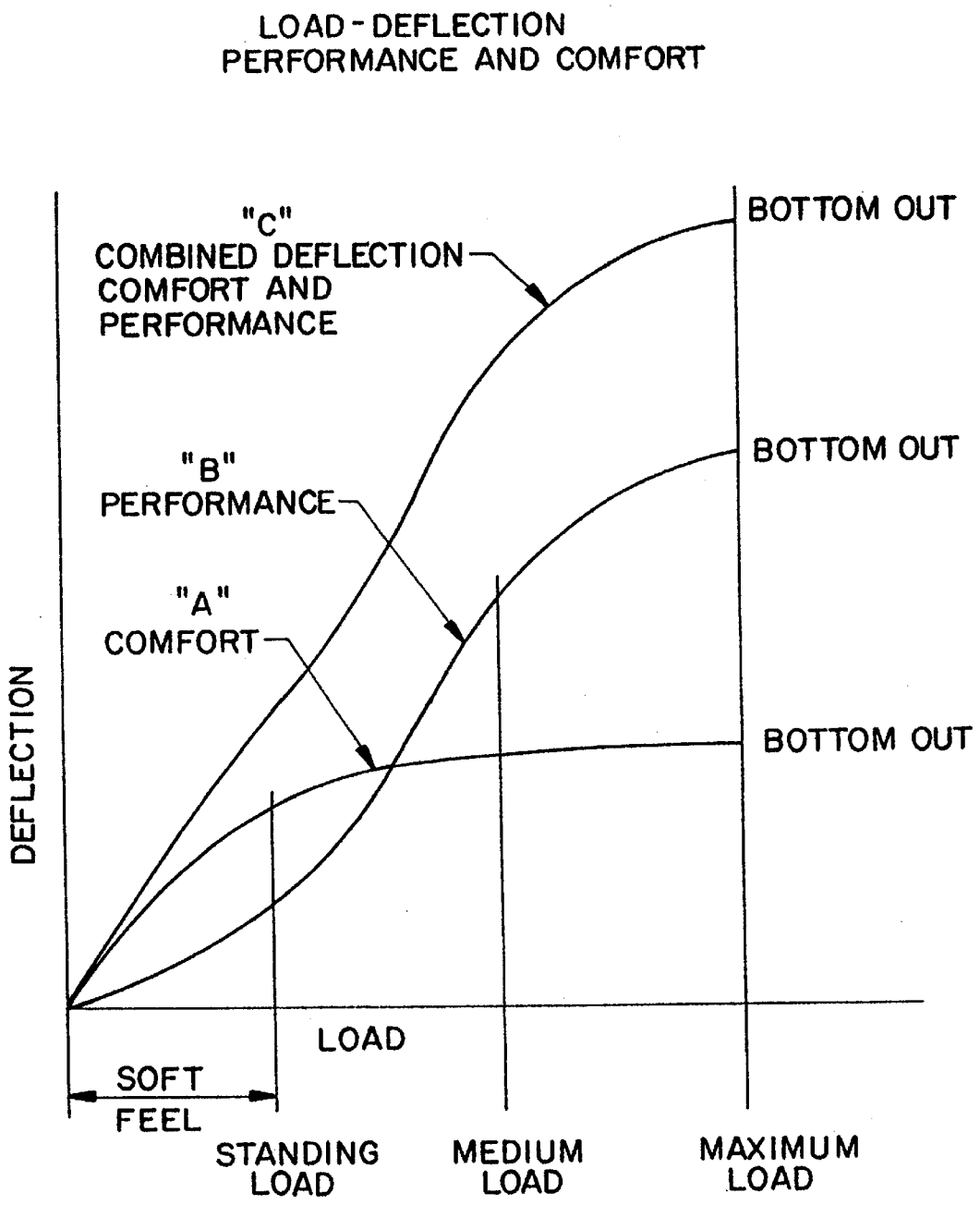
FIG. 6 is a graphical representation illustrating estimated load versus deflection and the associated comfort versus performance of a shoe including a preferred embodiment cushioning system.

FIG. 6 graphically represents the predicted load versos deflection performance of the subject invention. At a standing load, a relatively low pressure comfort cushioning device (curve "A") undergoes a significant amount of its potential deflection providing a "riding-on-air" feel. As load increases, the comfort cushioning device bottoms out. However, the performance cushioning device (curve "B") is rapidly undergoing deflection, while absorbing, cushioning, distributing, storing the potentially damaging impact force, and eventually returning this otherwise wasted energy to the wearer as a beneficial propulsion force. At maximum load both the comfort cushioning device and performance cushioning device approach bottoming out. The two cushions functioning together in tandem, spread the impact force over the greatest possible time interval, achieving maximum cushioning. Curve "C" shows the combined and unique synergistic effect of the two cushioning devices.

It is believed that when single air filled cushioning devices exceed 0.800 inches in shoes, instability arises as a result of a "tennis ball" effect Furthermore, when multiple air chambers are placed one atop the other to achieve a thickness greater than eight hundred thousandths of an inch, instability arises. In contrast, as shown in the current invention, a load distributing device between the upper and lower fluid containing cushioning inserts redistributes forces between the two chambers sufficiently to substantially avoid the "tennis ball" effect and allow the combined thickness of the two inserts to exceed 0.800 inches. Accordingly, cushioning inserts totalling a combined thickness of greater than 0.800 inches would appear to be effective when constructed in accord with the subject invention. As should be apparent to those skilled in the art, this feature significantly improves the cushioning ability of the shoe without a loss in stability.

Figure 7:
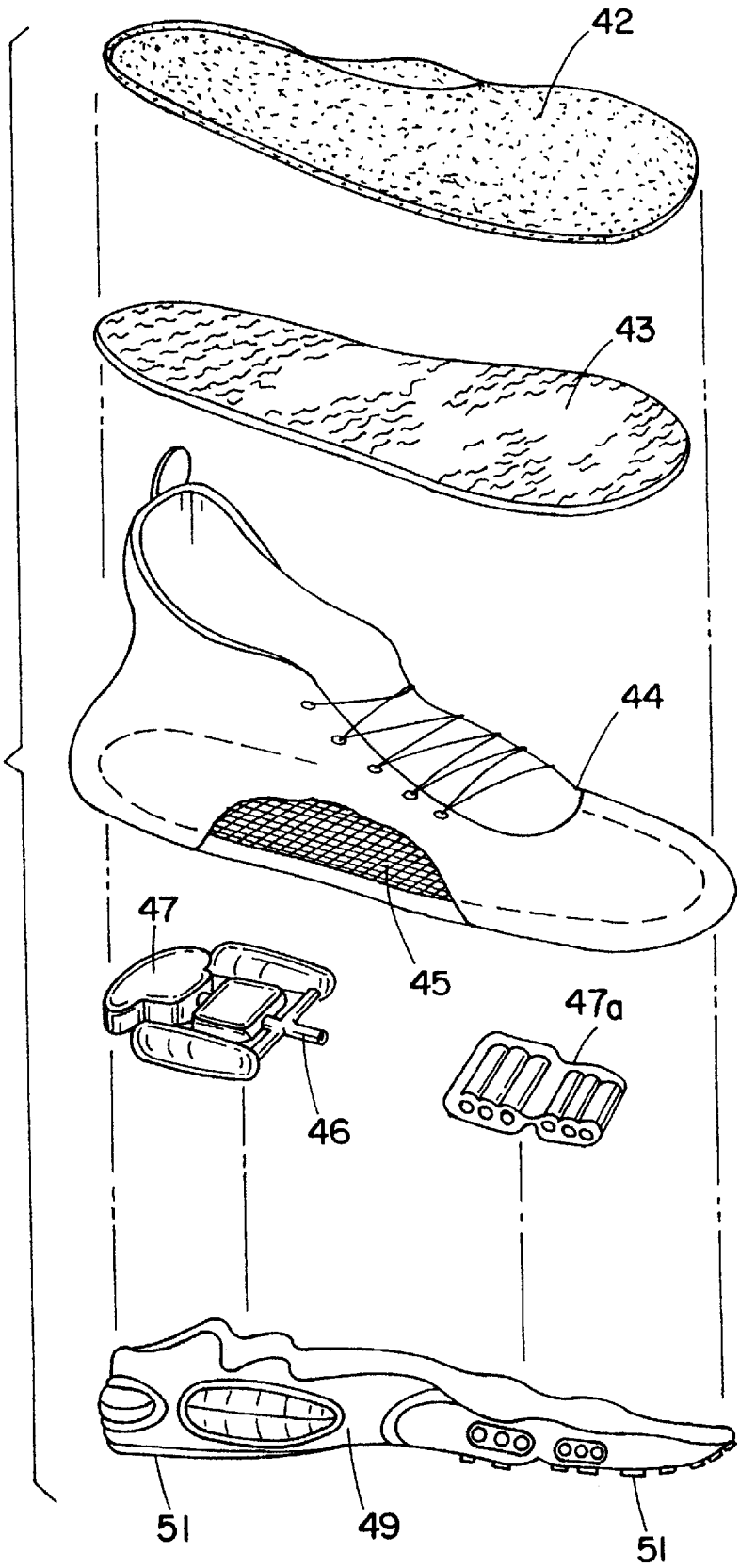
FIG. 7 is a perspective view illustrating the unassembled parts of a preferred embodiment shoe.

FIG. 7 represents the individual components in the exploded preconstruction stage of a preferred embodiment of the invention. In the embodiment, a sockliner 42 is positioned over an inboard fluid containing multichamber cushioning device 43. Both are positioned within the shoe upper 44 on top of load distributing element 45 comprised of a mesh, the filaments of which have a high tensile strength such as nylon, polyester, kevlar, fiberglass, metal, etc. which is optionally substituted for Robes or Texon board or cement reinforced fabric of a "stitch lasted" shoe. This shoe is then laid-up on top of performance fluid containing multichamber cushions 47 and 47*a* secured in midsole 49. In this embodiment, performance cushions 47 and 47*a* can be either permanently inflated (47*a*) or may be inflated with a valve 46. In one construction embodiment, it is envisioned that upper 44 would be secured around a last (not shown) and its fabric of other material sealed at its base by the load distributing element 45. The outboard performance fluid containing cushioning device is preferably foam encapsulated as an integral part of midsole 49. The outsole 51 is cemented to the midsole and the resultant product is securely cemented or otherwise attached to the shoe upper comprising the load distributed element. As can be seen, the cushioning devices are generally thicker in the heel area where maximum loading occurs, with the performance cushioning device being thicker than the comfort cushioning device.

Figure 8:
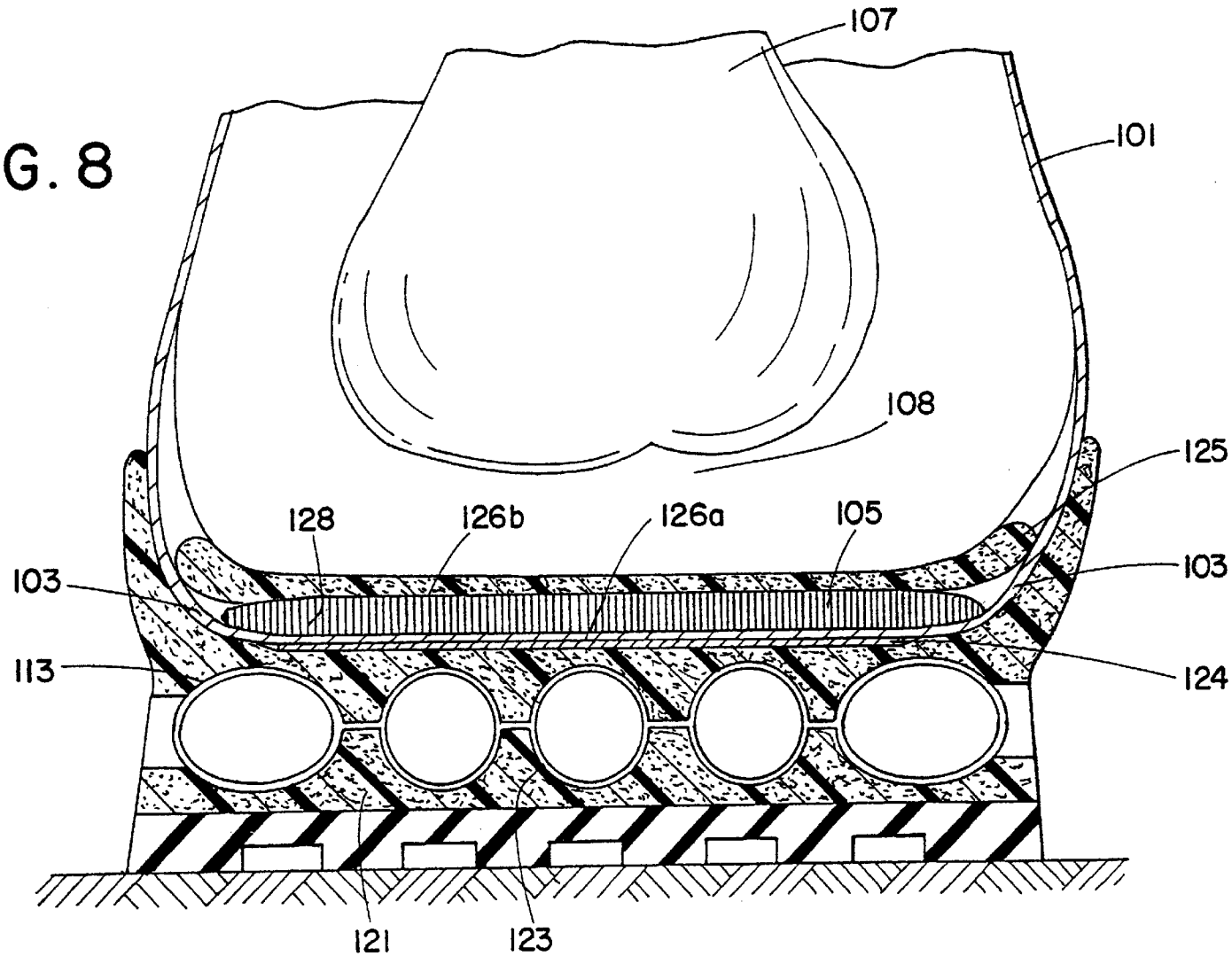
FIG. 8 is a diagrammatic view partly in section and partly in elevation similar to FIG. 2, of an alternative embodiment of the inventive shoe.
Figure 9A:
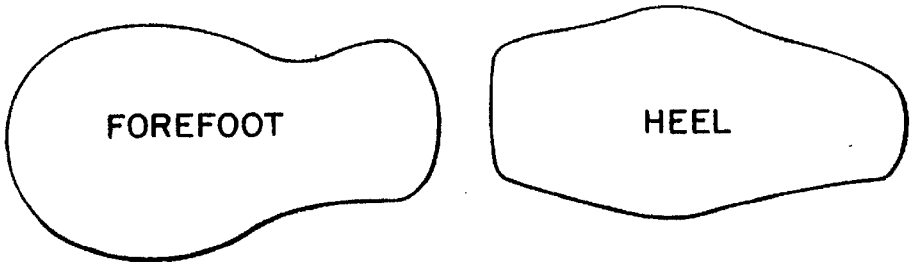
FIGS. 9A, 9B, 9C, and 9D are top views of exemplary load distributing elements.
Figure 9B:
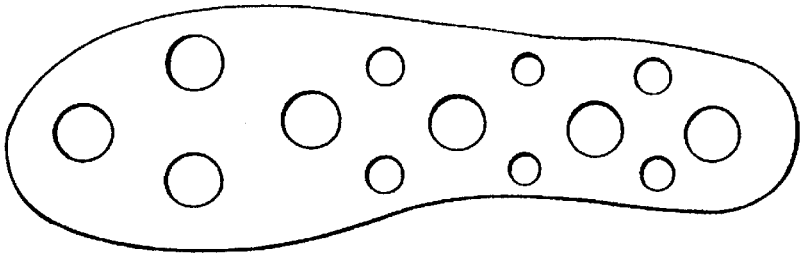
Figure 9C:
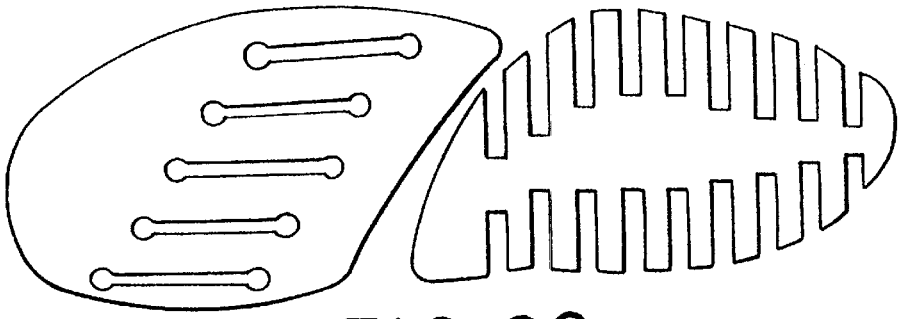
Figure 9D:
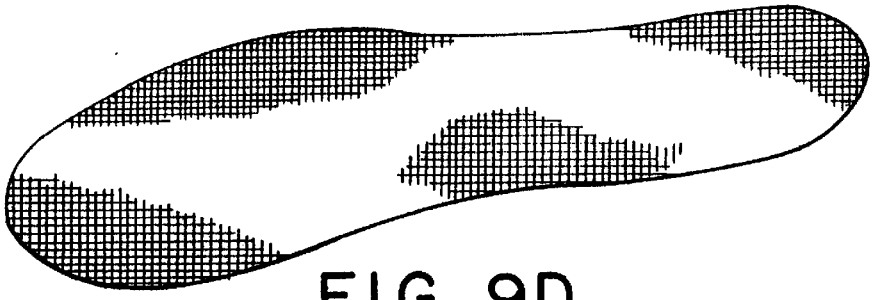

FIG. 8 illustrates an alternative embodiment of the invention, wherein shoe upper 101 is glued and/or stitched at its lower periphery 103 to an air filled cushion device 105. Air cushion device 105 is positioned above load distributing element 124. This air cushion comprises elastomeric layers 126*a* and 126*b* mechanically bonded with a drop thread linked fabric 128 as described in U.S. Pat. Nos. 4,906,502 and 5,083,361. Additionally, the comfort factor may further be enhanced by the use of a conventional anatomically shaped foam (or equivalent) sock liner 125. A second performance oriented cushioning device 123 is placed in midsole 113. Again, cushioning device 123 is foam 121 encapsulated. In this embodiment, calcaneus 107 and fat pad 108 are in elastomeric contact with comfort air cushion 105. Accordingly, the cushion device actually forms part of the lasted base of the foot enveloping upper. In this design, the cushioning device is functionally positioned inboard, and it remains in uninterrupted cushioning contact with the foot.

In this embodiment of the subject invention, the contiguous board-lasted or stitch lasted component of the shoe upper 103 can perform, at least in part, the function of the load distributed element, positioned between the first and second air cushioning devices 105 and 123.

The load distributing element(s) function in a key role in the subject invention, setting it apart from prior cushioning endeavors because it separates and isolates, at least in part, the function and load/deflection characteristics of the fluid containing cushioning device(s) positioned within the footwear constraining envelope of the shoe, i.e., the inboard component, from the lower fluid containing cushioning device(s) positioned within the midsole of the shoe, i.e., the outboard component. It is important to recognize that simply positioning one of the cushioning devices above the other cushioning device regardless of their pressurization, will result in an article of footwear having unacceptable dynamic instability similar to standing on a tennis ball if one or more load distributing element(s) is not utilized.

The load distributing element, in its multitude of various designs, shapes and materials, is a particularly important component of the invention, characterizing and distinguishing it from several prior attempt to incorporate liquid or pneumatic type cushions into stacked or nested designs. In some areas, such as directly beneath the calcaneus, it may be desirable to have the inboard and outboard cushioning devices working in part in unison to achieve a more significant deflection under maximum impact loading. Accordingly, the load distributing element may be cut out in the area below the calcaneus, i.e. in a "U"-shaped pattern. Thus, the maximum allowable deflection can be accomplished so as to spread the impact load over the maximum achievable time interval. In this manner, within the overall design constraint, the shoe transmit the lowest possible shock force to the foot, leg, body and head of the wearer. However, the cut-out region cannot be so extensive as to result in instability. Moreover, it is believed that at least the periphery of the load distribution element must remain intact to prevent a "tennis ball" effect. In the preferred embodiment, the load distributing element lies under at least 40% and preferably 50% at the foot's heel pad.

Preferably, the load distributing element comprises a flexible, thin and lightweight material which redistributes localized forces laterally across the interface of the two or more cushioning devices. The load distributing element separates and at least partially isolates and maximizes the beneficial features of the upper and lower fluid cushioning devices to optimize comfort, cushioning, and performance and simultaneously prevent localization of forces leading to various undesirable consequences including a foot injury, a "tennis ball" effect and/or an aneurism failure of the pressurized device. Particularly, preferred load distributing elements support at least the heel and metatarsal areas. These areas receive the greatest load and are most prone to injury and bottoming out. Accordingly, forces are more evenly distributed across the cushioning devices and the load distributing element itself may absorb and store some energy. Particularly preferred materials include Robus board, Texon board, a stitch lasted base of the upper, kevlar, metal mesh or fiber reinforced composites or combinations thereof. Certain load distributing elements, such as high modulus of elasticity materials, may also be utilized to provide energy return. A load distributing element suitable for use in this invention is described in U.S. Pat. Nos. 4,506,460 and 4,486,964, which are herein incorporated by reference. The load distributing element can be of any shape required to redistribute force. In fact, the type of athletic shoe may determine the load distributing element shape. Moreover, tennis shoes may require a greater load distributing element effect in the forefoot and running shoes in the heel. Several exemplary load distributing elements are shown in FIGS. 9A, 9B, 9C and 9D.

As described herein, forces within the shoe sole are considered normal in the plane of the load distributing element. Nominally vertical forces travel downward from the foot through the upper cushion to the load distributing element and upward from the outsole through the lower cushion to the load distributing element. The load distributing element distributes forces generally horizontally across the shoe and the two interactive cushioning devices, preventing a "tennis ball" effect. In the case of a "U-shaped" heel load distributing element, interaction occurs locally between the first and second cushioning members in the center of the heel which greatly dissipates the high load force under the calcaneus as a result of a greater deflection and absorption of shock load. Shock forces to the foot, leg, and body are significantly reduced. These designs avoid adding unnecessary weight to the shoe and maximize the interactive and load absorption and distribution nature of the top and bottom units in high impact areas while maintaining stability.

The load distributing element tray be comprised of either a low modulus (below about 250,000 psi) material or an intermediate (between about 250,000 and 1,000,000 psi) or high (above about 1,000,000 psi) modulus material or combinations thereof depending on the desired end objective. U.S. Pat. Nos. 4,486,964 and 4,506,460 directed to a spring load distributing element/stabilizer device clearly define the benefits of an intermediate and high modulus type of load distributing element. However, it should be noted that conventional shoe components utilized in constructing the shoe upper, and particularly the area supporting the plantar surface of the foot, are equally acceptable and fully functional within the scope of the subject invention, often without any significant modification. Accordingly, the load distributing element of the current invention could comprise, but is not limited to, the board of board lasted shoes, the board of tuck board lasted shoes and the reinforced cemented fabric of stitch lasted shoes. In addition, other portions of the shoe which may, depending on shoe construction, lie intermediate the inboard and outboard cushioning components such as, but not limited to, the heel counter, stabilizers, cantilevered support components, may form individually or as combinations of other components, the load distributing element.

It should be recognized that a spring type load distributing element has been shown to add improved stability and provide a significant energy return to the user; for example, the storage and return of impact energy can be as much as 6% more energy efficient than with a shoe structure without a spring load distributing element/air cushion combination. Furthermore, the use of the load distributing element has allowed the construction of air cushioning soles of significant thickness while achieving good to excellent stability. Moreover, a shoe has now been provided with superior comfort, i.e., a "riding-on-air" feel in combination with superior technical performance. Previously, it has been necessary to sacrifice comfort to achieve performance and vice-versa. In addition, the combination of these two fluid filled cushioning devices in combination with the load distributing element has the effect of providing greater cushioning in extreme loading conditions without bottoming out or instability.

In a preferred embodiment of the invention, an inboard cushioning device adjacent the foot has a thickness of less than 0.350 inches, more preferably about 0.250 inches. This requirement is important because movement of the foot within the upper, when exceeding more than one-third of an inch has been found to cause sufficient rubbing between the foot and the heel counter and other sections of the shoe resulting in uncontrolled movement of the foot within the envelope of the article of footwear and, blistering, irritation and abrasion of the foot surface. For optimum performance during high impact athletic endeavors, the outboard cushioning device below the load distributing element will preferably have a thickness of at least 0.400 inches, more preferably greater than 0.750 inches.

When a compressible fluid is utilized the cushioning device adjacent the foot is preferably pressurized to between greater than 0 and 20 pounds per square inch as defined by gage pressure and the cushioning device below the load distributing element is pressurized to a gage pressure of between about 5 and 50 pounds per square inch. The 0 and 20 pounds of pressure provides a soft feel to the foot, i.e. a highly resilient cushion. The 5 to 50 pounds of pressure in the device below the toad distributing element absorbs, distributes, stores, and returns potentially damaging and otherwise wasted impact energy in an energy efficient manner during walking, running and jumping. Accordingly, in a preferred embodiment, the shoe is provided with a "softer" cushioning device adjacent the foot to provide comfort, i.e. "riding-on-air", while the cushioning device adjacent the ground has a higher pressure and generally a greater thickness, providing high impact absorbance and stability for an athletic shoe. The phrase "riding-on-air" is appropriate because a preferred cushioning device is pressurized with a compressible fluid such as gas or air. When an incompressible fluid is utilized, the cushion members are not required to be pressurized. Preferably, the elastomeric cushioning device is filled to about 0 p.s.i.g.

In addition, the inventive shoe design facilitates customizing, optimizing and tailoring of the shoes comfort and performance characteristics. Moreover, the cushioning device adjacent the foot can be designed to have a lower pressure than the cushioning device adjacent the ground. In fact, the lower pressure comfort cushion adjacent the foot can be manufactured in a range of pressures and combined with a high pressure performance cushion having its own range of pressures to provide a shoe with a great diversity of applications, tailoring the shoes capabilities for different sports and sex or weight of the wearer.

As will be apparent to one of ordinary skill in the art, certain designs may incorporate the cushioning device adjacent the foot into the sock liner of the shoe. The cushioning device below the load distributing element can be comprised of one or several foam encapsulated multichamber units, a single chamber non-foam encapsulated unit or a combination thereof, i.e. foam encapsulation is not required.

Thus, it is apparent that there has been provided, in accordance with the invention, an article of footwear that fully satisfies the objects, aims and advantages set forth above. While the invention has been described in conjunction with specific embodiments thereof, it is evident that many alternatives, modifications, and variations would be apparent to those skilled in the art in light of the foregoing description. Accordingly, it is intended to embrace all such alternatives, modifications, and variations as fall within the spirit and broad scope of the appended claims.

I claim:

1. An article of footwear comprising:

a midsole;

an outsole disposed below said midsole;

a first sealed fluid containing cushioning device disposed between a top surface of said midsole and said outsole, said first sealed fluid containing cushioning device including a plurality of chambers, wherein at least a first chamber and a second chamber are in fluid communication via a connecting passage and wherein said plurality of chambers include a heel chamber and a ball-of-the foot area chamber; and a second sealed fluid containing cushioning device disposed above said top surface of said midsole and beneath a wearer's foot, wherein said second sealed fluid containing cushioning device is in fluid independence with said first sealed fluid containing cushioning device and, overlaps said heel chamber and said ball-of-the-foot area chamber.

2. An article of footwear comprising:

a fluid containing first sealed cushioning device disposed between a top surface of said midsole and said outsole, said first sealed cushioning device including chambers under at least a wearer's heel and ball-of-the-foot area; and a fluid containing second sealed cushioning device disposed above said top surface of said midsole and beneath at least the wearer's heel and ball-of-the-foot, wherein said second cushioning device is in fluid independence with said first cushioning device, and said first sealed cushioning device and said second sealed cushioning device having a combined thickness which does not exceed 0.800 inches.

3. An article of footwear comprising:

a midsole comprised of an elastomeric material;

an outsole disposed below said midsole;

a fluid containing first cushioning device at least partially encapsulated in said midsole and disposed between a top surface of said midsole and said outsole, said first cushioning device including a first chamber, a second chamber and a connecting passage connecting said first chamber and said second chamber; and a fluid containing second cushioning device having a lower pressure than said first cushioning device disposed above said top surface of said midsole and beneath a wearer's foot, wherein said second cushioning device has a thickness less than 0.250 inches and is positioned to provide substantially uninterrupted elastic cushioning from the heel to the toe of the foot.

4. The article of footwear of claim 3 wherein the first cushioning device and the second cushioning device having a combined thickness which does not exceed 0.800 inches.

5. The article of footwear of claim 3 further comprising a sockliner disposed above said second cushioning device.

6. The article of claim 3 wherein said first and second cushioning devices are comprised of polyurethane.

7. The article of claim 4 wherein said first and second cushioning devices are positioned under substantially the entire plantar's surface of a foot.

8. The article of claim 3 wherein the fluid in at least one of said cushioning devices is compressible.

9. The article of claim 3 wherein the fluid of said first cushioning device is compressible and the fluid of said second cushioning device is incompressible.

10. The article of claim 3 wherein said second cushioning device has a gage pressure of between 0 and 20 psi and said first cushioning device has a gage pressure of between about 15 and 50 psi.

11. The article of claim 3 wherein said connecting passage includes a flow restrictor.

12. The article of claim 3 wherein said second cushioning device is positioned under substantially the entire plantars surface of a foot.

13. The article of claim 3 wherein said second cushioning device is located within an upper.

* * * * *